US007959125B1

(12) United States Patent
Coleman

(10) Patent No.: US 7,959,125 B1
(45) Date of Patent: Jun. 14, 2011

(54) METHOD OF ASSEMBLING A CONCRETE WALL AND FOOTING FORM WITH CLEAT FOR SUPPORTING REBAR AND CONCRETE FORM

(76) Inventor: Chuck E. Coleman, Kent, WA (US)

( * ) Notice: Subject to any disclaimer, the term of this patent is extended or adjusted under 35 U.S.C. 154(b) by 1164 days.

(21) Appl. No.: 11/317,747

(22) Filed: Dec. 23, 2005

(51) Int. Cl.
*E04G 21/10* (2006.01)
*E04G 11/08* (2006.01)

(52) U.S. Cl. ..... 249/34; 249/93

(58) Field of Classification Search ..... 249/34, 249/91, 93; 52/741.13, 741.15
See application file for complete search history.

(56) References Cited

U.S. PATENT DOCUMENTS 4,339,106 A 7/1982 Navarro ..... 249/219
4,678,156 A 7/1987 Scalamandre et al. ..... 249/34
5,937,604 A 8/1999 Bowron ..... 52/426
6,161,360 A 12/2000 Smith ..... 52/678
6,591,574 B2 7/2003 Humphrey ..... 52/678
6,883,289 B2 4/2005 Juedes et al. ..... 52/687

*Primary Examiner* — Michael Safavi
(74) *Attorney, Agent, or Firm* — Dean A. Craine

(57) ABSTRACT

A footing cleat used to construct a concrete footing with integrally attached concrete wall located thereon. In the first embodiment, the cleat includes an elongated footing member with two downward brackets attached to its opposite ends. During use, the footing member is aligned transversely over the top edge surfaces of two sideboards used to construct the footing's concrete form. The brackets extend downward over the outside surface of the two sideboards. Extending upward from the footing member is a vertical wall support member. Formed on the wall support member is a plurality of holes used to receive nails or pins that hold pieces of horizontally aligned rebar used in a vertical wall constructed over the footing. The nails or pins are designed to temporally hold the pieces of horizontal rebar in place until the entire rebar wall is constructed. They can then be easily removed so that the cleat can be disassembled from the footing.

1 Claim, 7 Drawing Sheets

METHOD OF ASSEMBLING A CONCRETE WALL AND FOOTING FORM WITH CLEAT FOR SUPPORTING REBAR AND CONCRETE FORM

BACKGROUND OF THE INVENTION

1. Field of the Invention

This invention pertains to temporary concrete forms used to construct footers for a building, and more particularly to cleats used with concrete forms designed to hold the sides of the form together and to support steel rebar located therein at desired locations.

2. Description of the Related Art

Concrete footings are made by pouring concrete into wooden forms that are temporarily assembled onsite. After the concrete has cured, the forms are disassembled and removed from the footing and then reassembled at other locations.

It is important that the forms are made of material that can remain in position on the ground and can hold wet concrete. Metal stakes are commonly driven into the ground adjacent to the side and end boards on the form to temporarily hold the forms in place. Wooden spacer boards are transversely aligned and attached to the top surfaces of the side boards at selected locations to keep the side boards apart and to keep them from bowing outward when concrete is poured inside the form.

Steel rebar is often placed inside the footing at desired locations to increase its strength. The rebar is often tied to secondary braces, clips or scaffold structures that hold them in their desired locations inside the form. The braces, clips and scaffold structures are sufficiently strong enough to hold the rebar, and capable of being easily assembled and disassembled.

Many footings used with residential houses and small buildings require vertically aligned "J" shaped rebar equally spaced apart along the length of the footing. The rebar is positioned so that the rebar's angled section extends into the form's cavity while its straight leg extends vertically upward. The straight leg usually connects to concrete blocks or to rebar used to construct an upper wall supported by the footing.

Building construction requires timely coordination of different subcontractors and suppliers. Certain tasks must be completed before other tasks can be started. For example, the excavators must clear the ground or prepare trenches before the labors can assemble the forms used to construct the footings. The wooden sideboards and rebar must be delivered to the job site before concrete can be poured. Even after the forms and the rebar have been assembled, they must be inspected.

Unfortunately, delays can occur that prevent some tasks from being completed. If workers and materials for a particular task are available it may be cost effective to allow the workers to start one task that may normally be completed only after the incomplete task is completed. An example of task that may be started or completed out of sequence is the assembly of rebar wall over a footing before the footing form as been inspected or poured. The height and length of the rebar wall constructed is often determined by the strength of the braces, clips or scaffold structures used to support them.

SUMMARY OF THE INVENTION

It is an object of the present invention to provide a cleat used with concrete footings designed to temporarily hold the sideboards on the footing at a desired distance.

It is another object of the present invention to provide a cleat capable of holding rebar vertically aligned over the footing.

It is another object of the present invention to provide a cleat that can be used to support a rebar wall structure.

It is another object of the present invention to provide a cleat that can be easily adjusted to accommodate different heights of walls.

It is a further object of the present invention to provide such a cleat that can be easily removed from the footing and to rebar wall structure after the concrete has been poured and set.

These and other objects of the present invention are met by the concrete footing cleat disclosed herein designed to be placed transversely over the top edges of two, parallel, sideboards used to construct a footing form. The cleat includes an elongated footing member with a centrally located, perpendicularly aligned, upward extending wail support member attached thereto. The footing member includes a means for securely attaching it in a transverse position over the top edges of the two sideboards.

In the first embodiment, the footing member is a straight square tubular member with two downward extending end brackets attached to its opposite ends. The tubular member is sufficient in length to extend transversely over the top edges of the two sideboards. The two end brackets are parallel and extend perpendicularly downward from the tubular member so that they extend over the outer surfaces of the two sideboards. Nails or other suitable connectors are used to connect the two end brackets to the outer surfaces of the two sideboards.

In a second embodiment, the footing member is a flat plate that attaches to the top surfaces of the two sideboards. In a third embodiment, the footing member is a downward extending angle bar designed to be placed over the top surface of a wood support member that extends transversely between the two sideboards. Nails or other suitable connectors are used to temporarily attach the angle bar to the wood support member. In a fourth embodiment, the footing member is an upward extending angle bar with two downward brackets attached to its opposite ends that engage the two sideboards.

When the footing member is transversally aligned over the two sideboards, the wall support member extends upward to support one or more pieces of horizontally aligned rebar. The pieces of horizontal rebar may be used to construct a vertical wall over the footing. When pieces of vertical rebar are placed into the form the ends of the rebar may extend upward and attach to the horizontally align rebar supported by the wall support member on the cleat. In the preferred embodiment, the wall support member is a hollow square tube with a plurality of transversely aligned holes formed on its lateral surfaces. The holes are aligned parallel to the wall support member so that when a nail or pin is inserted through them and may be used to support a piece of rebar. The holes are equally spaced apart on the two lateral surfaces of the wall support member and designed to receive and hold a duplex nail commonly used in form construction or a special hook pin disclosed herein. Because the holes are equally apart, they may be used as a measuring tool for aligning the pieces of horizontally aligned rebar at their desired heights. The nail or hook pin must be sufficient in length so that during use it extends through the wall support member and temporarily supports one or two pieces of rebar on opposite sides of the wall support member.

In one embodiment, the wall support member selectively attaches to a short stub attached to the wall support member. The wall support member and footing member can be easily disassembled and stored in a compact manner. Also, different styles of footing members and different lengths of wall support members may be exchanged for different footings and walls.

An optional extension pole may be provided that increases its overall length for constructing high rebar walls over the footing form. The extension wall support member includes holes similar to the holes formed on the main wall support member designed to receive a nail or hook pin to support pieces of horizontally aligned rebar.

Using the above-described cleat, a method of constructing a concrete footing and wall structure is disclosed.

DESCRIPTION OF THE PREFERRED EMBODIMENT(S)

Figure 1:
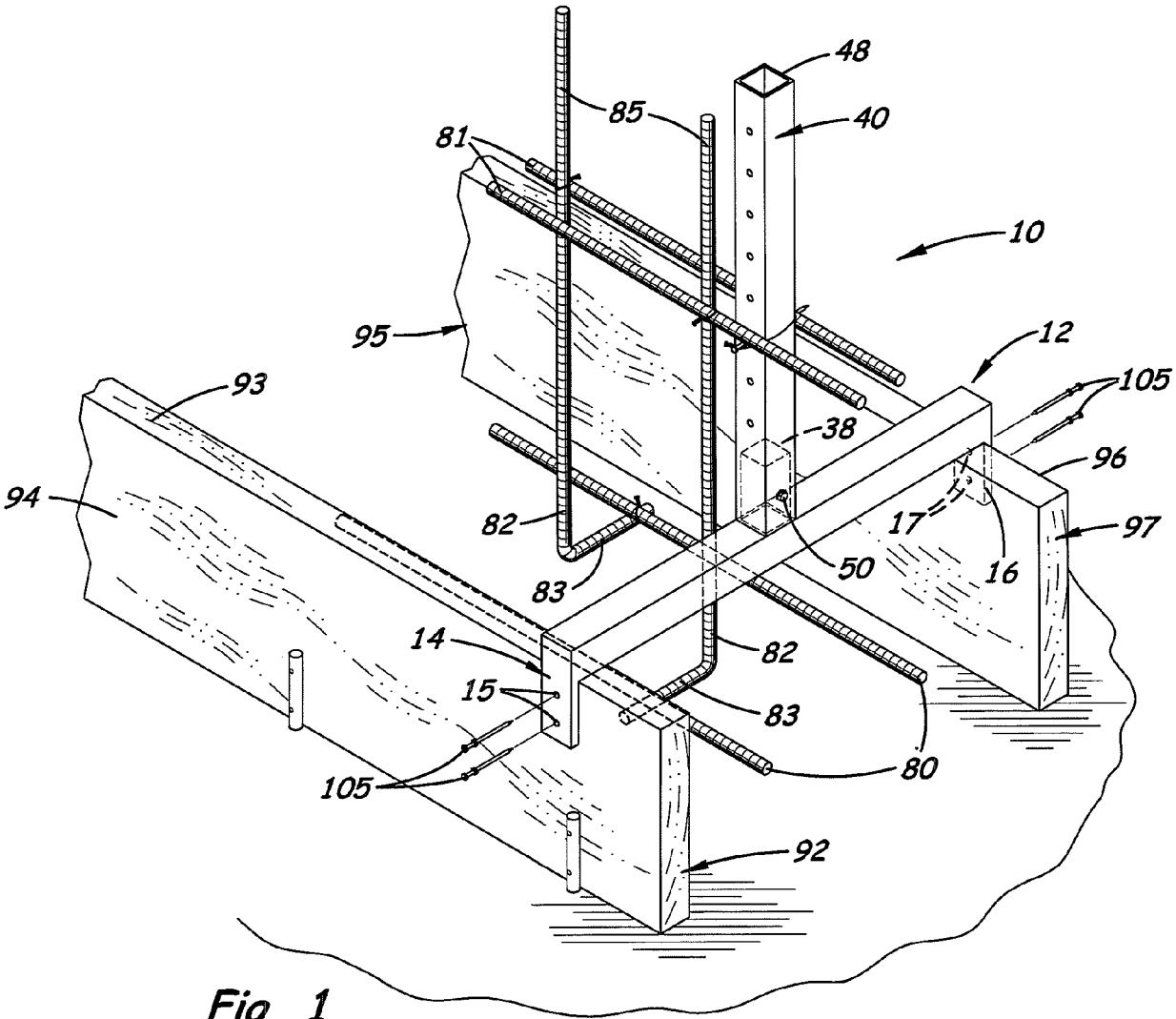
FIG. 1 is a perspective view of the first embodiment of the footing cleat attached to a footing form.

In the accompanying FIGS. 1-9 there is shown a relatively simple, inexpensive concrete footing cleat 10 designed to hold two, parallel side boards 92, 94 in a fixed, spaced apart position to construct a concrete form 90 and used to support pieces of horizontal 81 and vertical angle rebar 82, placed inside the form 90. The cleat 10 is also used to support pieces of horizontal rebar 81 located above the form 90 used to construct a rebar wall or cage above the form 90.

FIG. 1 shows the first embodiment of the cleat 10 that includes an elongated footing member 12 designed to be transversely aligned over the top surfaces 93, 96 on two side boards 92, 95, respectively. In the first embodiment, the footing member 12 is a square tube 13 made of steel or aluminum approximately 1 inch in width and 18 to 76 inches in length. Attached to the opposite ends of the footing member 12 are two downward extending end brackets 14, 16. The brackets 14, 16 are rectangular plates with one or more holes 15, 17, respectively, formed therein each designed to receive a nail 105 to temporarily attach the foot member 12 to the outside surfaces 94, 97 of the two side boards 92, 95, respectively. The two end brackets 14, 16 are made of steel or aluminum and are approximately 1 inch in width and 2 inches in length.

Figure 2:
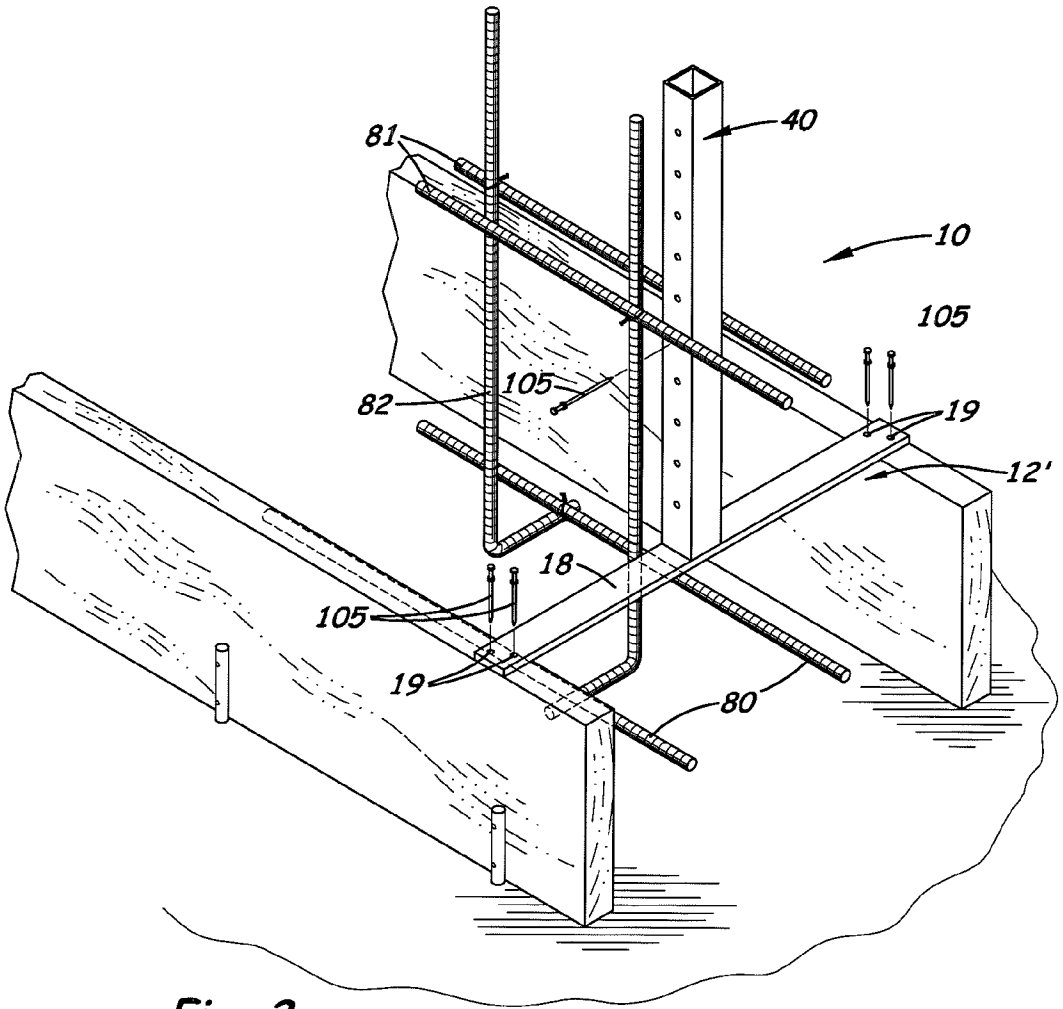
FIG. 2 is a perspective view of a second embodiment of the footing cleat attached to a footing form.

Shown in FIG. 2, is a second embodiment of the footing member denoted 12' comprising a flat plate 18 designed to extend between the top surfaces 93, 96 and two sideboards 92, 95, respectively. Nails 105 are inserted through holes 19 formed on the opposite ends of the flat plate 18 to attach the flat plate 18 to the two sideboards, 92, 95. The footing member 12' is made of steel or aluminum approximately 18 to 76 inches in length.

Figure 3:
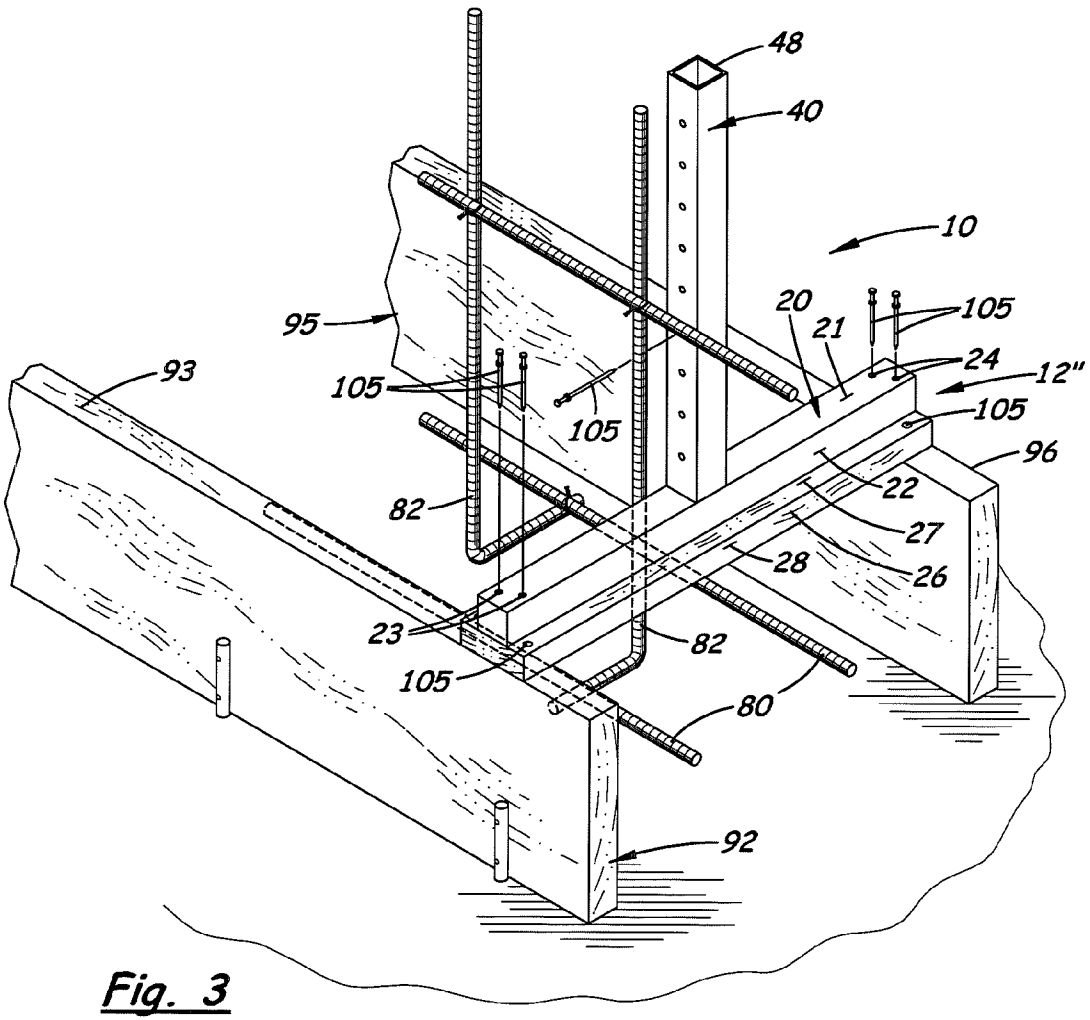
FIG. 3 is a perspective view of the third embodiment of the footing cleat attached to a footing form.

Shown in FIG. 3 is a third embodiment of the cleat that used another footing member, denoted 12" that includes a downward extending angle bar 20 designed to be used with a wood support board 26. In the preferred embodiment, the wood support board 26 is square or rectangular in cross-section and sufficient in length to extend transversely between the two sideboards 92, 95. Nails 105 are used to temporarily attach the wood support board 26 to the top surfaces 93, 96. The angle bar 20 includes a flat horizontal flange 21 and a downward extending flat vertical flange 22. Formed on opposite ends of the horizontal flange 21 are holes 23, 24 designed to receive nails 105 or other suitable connectors that attach the horizontal flange 21 to the top surface 27 of the wood support board 26.

Figure 4:
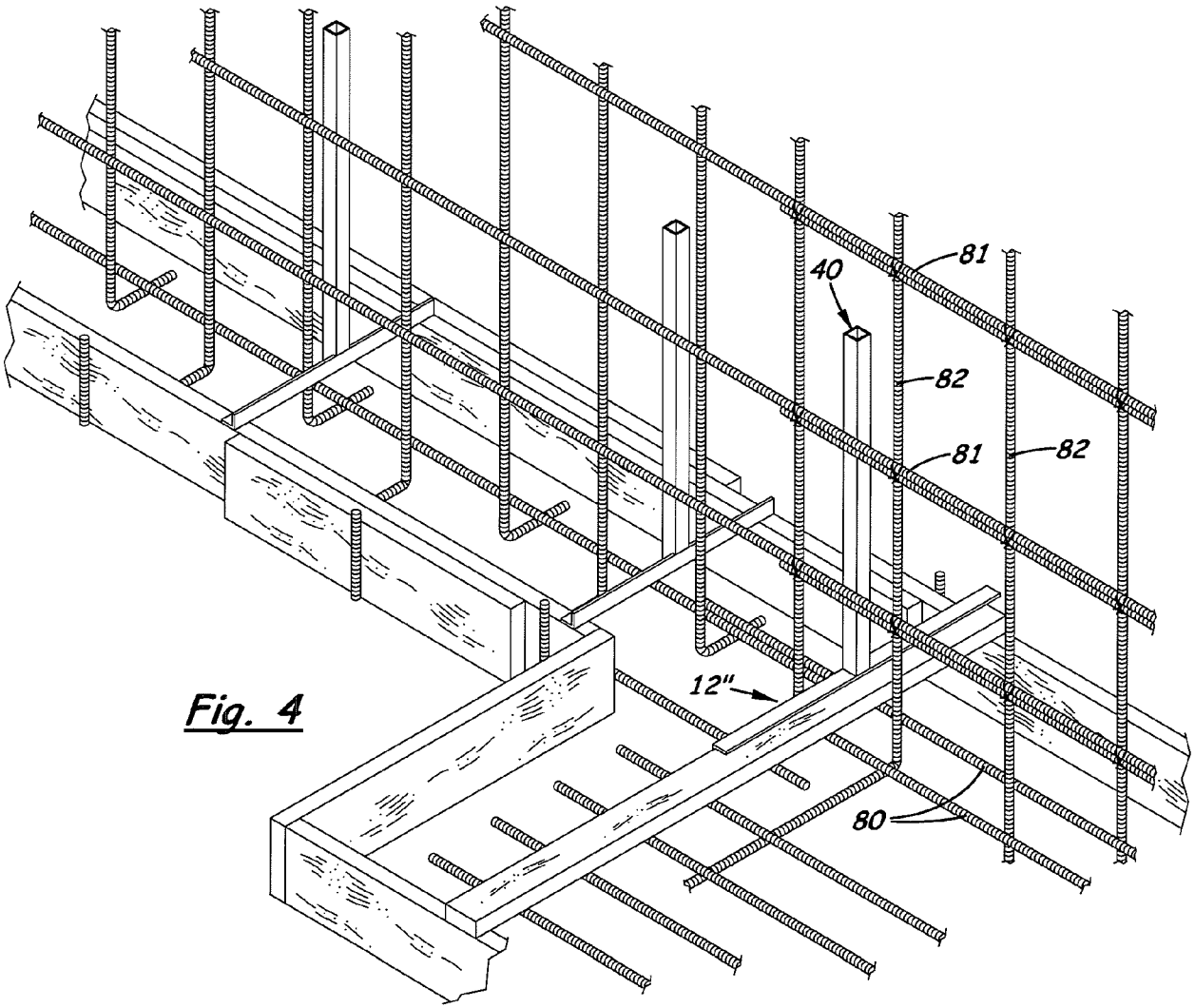
FIG. 4 is a perspective view of the footing cleat shown in FIG. 3 used with a long support member.

FIG. 4 shows the third embodiment of the cleat 10 with the footing member 12"shown in FIG. 3 being attached to a long wood support board 26' designed to be used to extend transversely over a wide form.

Figure 5:
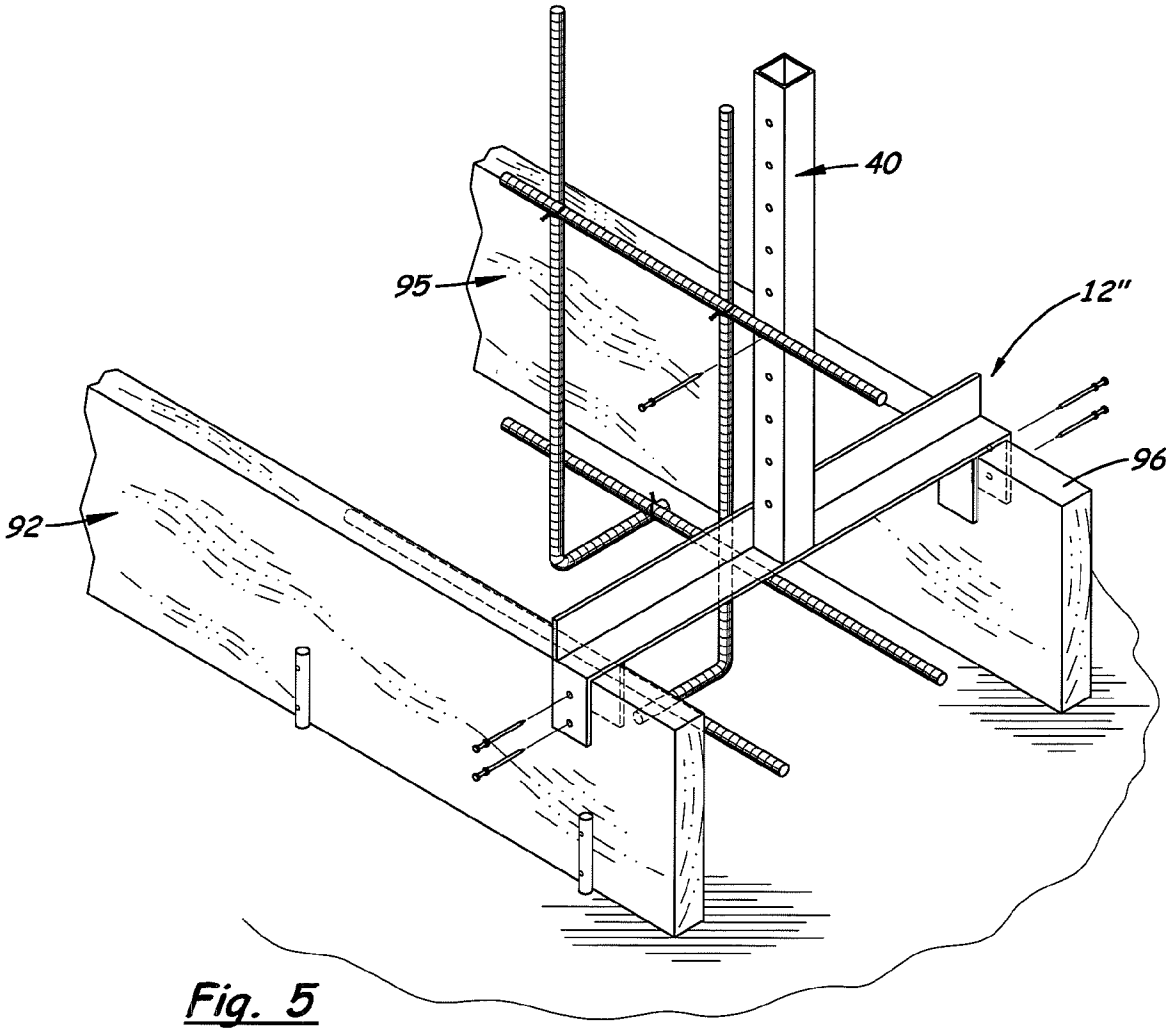
FIG. 5 is a perspective view of a fourth embodiment of the footing cleat.

FIG. 5 shows a fourth embodiment of the cleat 10 that uses another footing member, denoted 12''', that includes an upward extending elongated angle bar 30 with two downward extended U-shaped brackets 34, 36 attached to its opposite ends. The footing member 12''' includes a horizontal flange 121 and an upward extending vertical flange 122. The vertical flange 122 is designed to provide strength. The brackets 34, 36 are sufficiently wide and designed to slide over the top surfaces 93, 96 of the sideboards 92, 95, respectively, to hold the cleat 10 in a fixed position on the form 90. An important benefit of using the brackets 34, 36 is that nails may be needed to hold the cleat 10 on the two sideboards.

Figure 8:
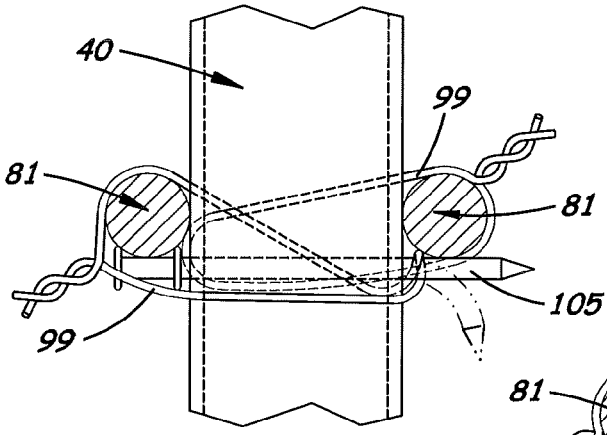
FIG. 8 is a sectional side elevational view of the wall support member with two nails supported by a duplex nail connected to the wall support member.
Figure 9:
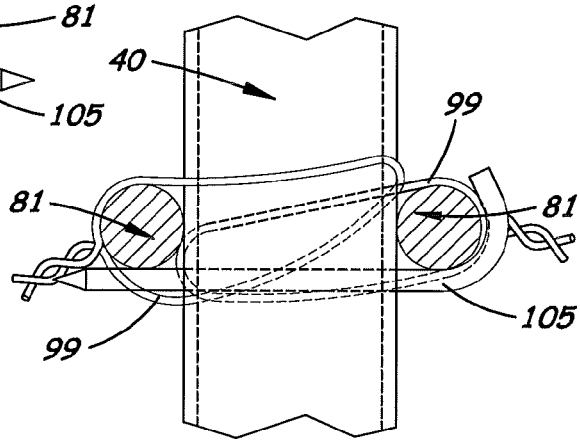
FIG. 9 is a sectional side elevational view of the wall support member with a hook pin used to support two pieces of rebar.

Attached to the footing member 12, 12', 12", 12''' is an upward extending wall support member 40 that is used to hold at least one horizontally aligned rebar 81 above the form 90. In the preferred embodiment, the wall support member 40 is made of square tubing 42 with a plurality of holes 44, 46 formed on its lateral surfaces 43, 45, respectively. The holes 44, 46 on the lateral surfaces 43, 45 are transversely aligned and equally spaced apart and designed to receive a duplex nail 105, as shown in FIG. 8, or a hook pin 110 shown in FIG. 9. The nail 105 and hook pin 110 are sufficient in length so that their head extends outside the adjacent lateral surface while their tips extend beyond the opposite lateral surface.

In most instances, the tips are bent downward to prevent the nail 105 or hook pin 110 from being removed from the wall support member 40. During use, a horizontal aligned rebar 81 may be rested on the head or on the tip of the nail 105 or hook pin 110 to temporarily hold the rebar 81 in position. Tie wire 99 may be wrapped around the rebar 81, around the head and tip of the nail 105 or hook pin 110 and around the wall support member 40 to temporarily hold the rebar 81 until the entire footing cage or wall is constructed. After all the footing and wall cages have been constructed, the nails 105 or hook pin 110 may be removed.

Figure 6:
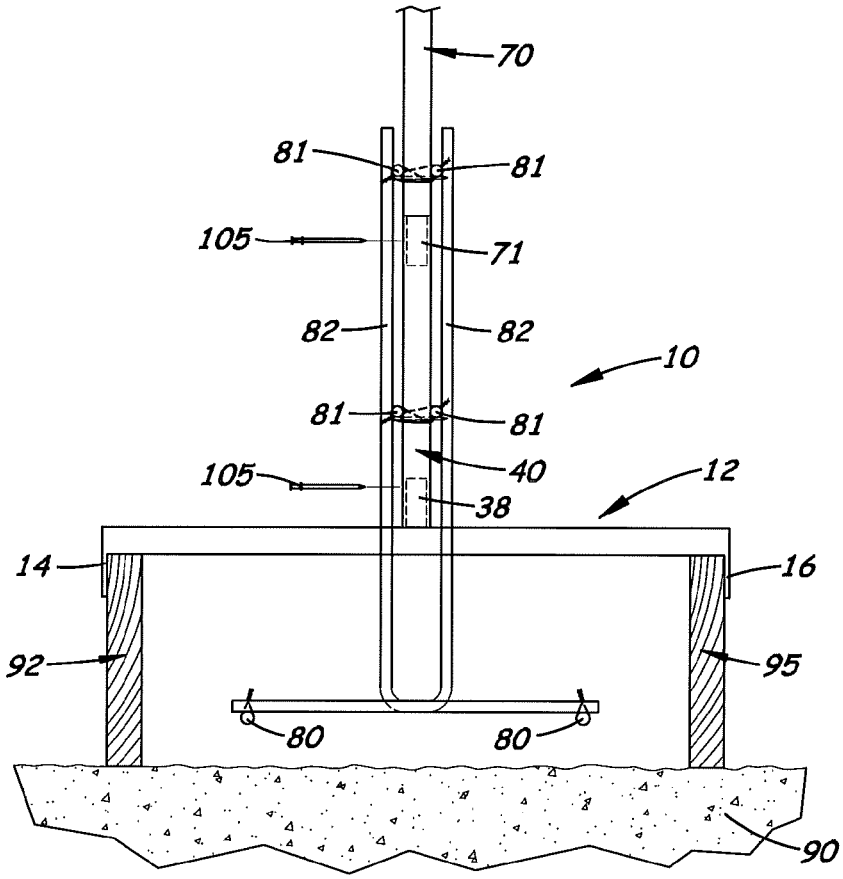
FIG. 6 is a side elevational view of the footing cleat on a footing form with an extension pole attached to the wall support member.
Figure 7:
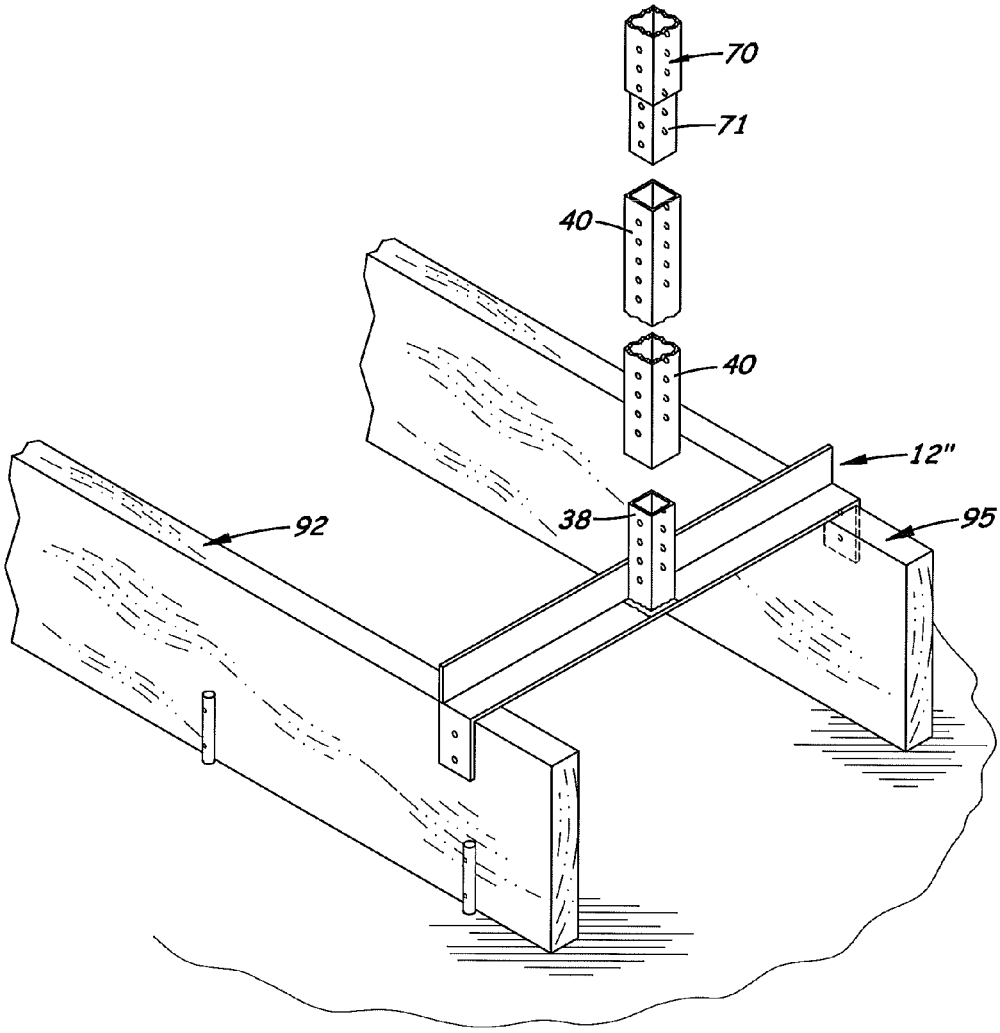
FIG. 7 is a perspective view of another embodiment with a second embodiment of the extension pole.

As shown in FIGS. 1 and 7, in the first embodiment of the foot member 12, a short square stub 38 is attached to the foot member 12 upon which the wall support member 40 selectively attaches. In the preferred embodiment, the stub 38 is centrally aligned on the wall support member 40. An optional pin 50 is inserted through holes (not shown) formed on the stub 38 and on the lower end of the wall support member 40 to connect the wall support member 40 to the stub 38. In the embodiments shown in FIGS. 2-6, the wall support member 40 is welded directly to the foot member 12', 12", 12'''. In all the embodiments, the wall support member 40 can be made in different lengths and can be used with different wall heights.

As shown in FIGS. 6 & 7, an optional extension pole 70 is provided that slides into the center cavity 48 in the wall support member 40 to support higher walls. The extension pole 70 is made of square tubing with a reduced neck 75 slightly smaller in cross section of the wall support member 40 so that it may slide freely therein. Holes 72, 74 are formed on its lateral surfaces 73, 75 respectively. During assembly, the holes 72, 74 on the extension pole 70 are registered and aligned with holes 34, 36 formed on the wall support member 40. A nail 105 or hook pin 110 is extended through the holes 44, 46 to selectively attach the extension pole 70 to the wall support member 40.

A typical footing with a vertical wall constructed thereover includes a plurality of angle rebar 82 that are vertically and equally spaced apart along the footing. The upper portion of each angled rebar 82 called a tail 85 extends upward and above the footing. A vertical rebar cage used to construct a wall may be connected to the tails 85 to couple the finish wall to the footing. Each angle rebar 82 includes an angle section 83 that connects to straight horizontal rebar 80 located inside the form 90.

When constructing a footing, a plurality of angle rebar 82 are spaced apart and vertically aligned inside the form 90. One or two upper rebars 81 are longitudinally aligned over the form 90 to which the tails 85 of the angle rebars 82 are attached.

During use, a plurality of cleats 10 are spaced 4 to 6 feet apart along the top surfaces of the form 90. Before connecting to the tails 85 and the upper horizontal rebars 81, the upper rebars 81 are first connected to the adjacent wall support members 40. The nails 105 or hook pins 110 temporarily hold the upper horizontal rebar 81 on the wall support members 40. The angle rebars 82 are then vertically aligned and spaced apart along the form 90. The angle section 83 of each angle rebar 82 connects to one or more-horizontal rebars 80 that extend longitudinally inside the form 90. The tails 85 of each angle rebar 82 are then tied to the upper horizontal rebars 81. Once the concrete in the form 90 is poured and cured, the cleats 10 can then be removed from the form 90. The nails 105 or hook pins 110 can be removed to enable the cleats 10 to be disconnected from the rebar wall.

Using the above-described cleat/method of constructing a concrete footing and wall structure is disclosed. The method includes the following steps:

a. constructing a concrete footing cleat made of two, parallel sideboards spaced apart a desired distance for a footing;

b. selecting a concrete footing cleat that includes an elongated footing member and a perpendicularly aligned wall support member, said wall support member includes a plurality of holes each designed to receive a nail sufficient in length to extend beyond the sides of said wall support member;

c. attaching said concrete footing cleat member transversely over said sideboards; and, d. inserting a nail into a hole on said wall support member at a desired height above said footing.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method of constructing a concrete wall footing, comprising the following steps:

a. assembling a concrete footing form made of two vertically aligned side boards with a center footer cavity formed therebetween;

b. selecting a plurality of footing cleats, each said footing cleat includes a footing member capable of being transversely aligned over said side boards used to form said concrete footing form and a centrally, perpendicularly aligned wall support member, said wall support member includes a plurality of nail holes formed there through;

c. aligning said footing cleats transversely over said side boards so that said footing member is transversely aligned over said side boards and said wall support member extends perpendicularly upward over said center footer cavity, said footing cleats being sufficiently spaced apart over said side boards so that a piece of horizontal aligned rebar located above said center footer cavity may be extended between adjacent said wall support members and supported over said footing form;

d. temporarily attaching each said footing cleat to said side boards;

e. selecting a plurality of J-shaped rebar pieces include a hook portion and a tail portion, each said rebar piece being aligned so that said hook portion is inserted into said center footer cavity formed in said footing form and said tail is extended upward from said footing form and parallel to said wall support member;

f. determining the location of a piece of horizontal rebar to be used in a wall located above said footing form;

g. selecting a nail or pin having sufficient diameter to be inserted into said nail or pin hole formed on said wall support member, said nail or pin being insufficient in length so that a portion of said nail or pin is exposed on one side of said wall support member;

h. inserting said nail or pin into one said nail or pin hole located at the desired height of a piece of horizontal rebar that extends across said wall support member;

i. selecting a piece of horizontal rebar to be used in a wall to be formed above said footing form; and, j. positioning said horizontal rebar piece over the exposed portion of said nail or pin that extends laterally from said nail or pin hole formed on said wall support member to temporarily hold said horizontal rebar piece in position on said wall support member.

* * * * *